US005135615A

United States Patent [19]

Rökman

[11] Patent Number: 5,135,615

[45] Date of Patent: Aug. 4, 1992

[54] DEVICE FOR MEASURING THE CONDITION OF A FELT AND FOR RECONDITIONING IT

[75] Inventor: Bo Rökman, Kangasala, Finland

[73] Assignee: Tamfelt Oy Ab, Tampere, Finland

[21] Appl. No.: 717,144

[22] Filed: Jun. 18, 1991

[30] Foreign Application Priority Data

Jul. 3, 1990 [FI] Finland ..... 903349

[51] Int. Cl.[5] ..... D21F 1/32; G01N 15/08

[52] U.S. Cl. ..... 162/263; 73/38; 162/198; 162/278; 162/279

[58] Field of Search ..... 162/277, 278, 279, 198, 162/199, 263; 73/38, 37.7

[56] References Cited

U.S. PATENT DOCUMENTS

| | | | |
|---|---|---|---|
| 2,308,574 | 1/1943 | Vickery | 162/278 |
| 3,056,281 | 10/1962 | Smyth | 73/38 |
| 3,762,211 | 10/1973 | Poulsen | 73/38 |
| 4,880,499 | 11/1989 | Pikulik | 162/275 |

FOREIGN PATENT DOCUMENTS

| | | |
|---|---|---|
| 1143982 | 8/1979 | Canada . |
| 1458294 | 2/1973 | United Kingdom . |

*Primary Examiner*—Karen M. Hastings
*Attorney, Agent, or Firm*—Lowe, Price, LeBlanc & Becker

[57] ABSTRACT

Device for measuring the condition of a felt (4) in a paper machine and for reconditioning it, comprising a measuring head (7) provided with a suction chamber (7*b*) and a measuring surface (7*a*) to be positioned against the surface of the felt (4) and provided with suction holes (15) leading into the suction chamber (7*b*); a suction conduit (17) leading out of the suction chamber (7*b*) and communicating with a vacuum source (9) for sucking air and water through the suction holes (15) from the felt (4) into the suction chamber (7*b*) and for discharging water and air from the suction chamber (7*b*); and measuring means (18) for measuring the vacuum pressure in the suction chamber (7*b*). In the reconditioning and measuring device according to the invention, the measuring head (7) comprises two suction conduits (16, 17) for sucking water and air, respectively. The first suction conduit (16) is positioned in the lower portion of the suction chamber (7*b*) for discharging mainly water from the suction chamber (7*b*) and the second suction conduit (17) is positioned in the upper portion of the suction chamber (7*b*) for discharging mainly air from the suction chamber (7*b*).

5 Claims, 3 Drawing Sheets

FIG. 3b
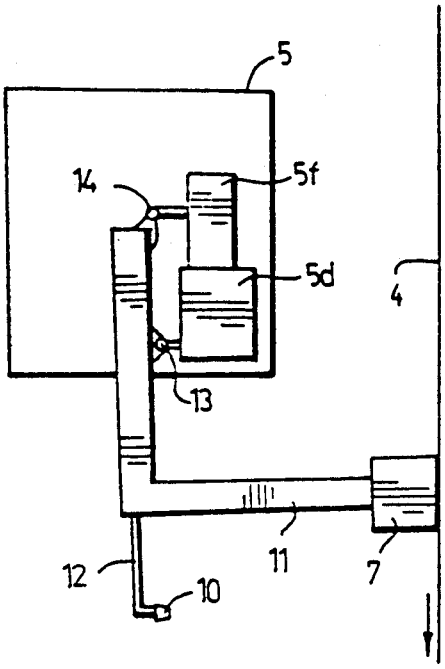
FIG. 3a
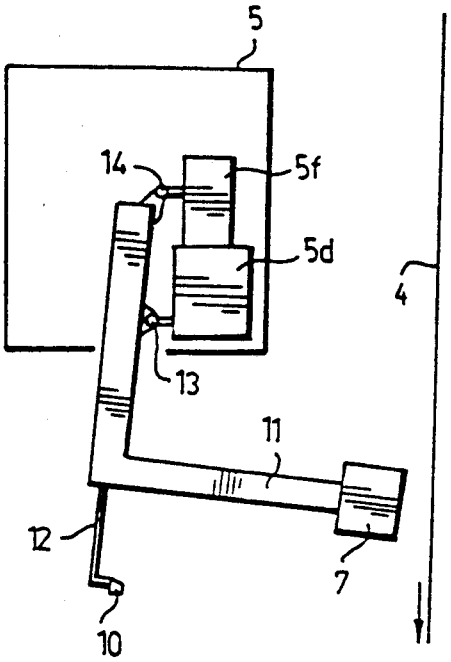
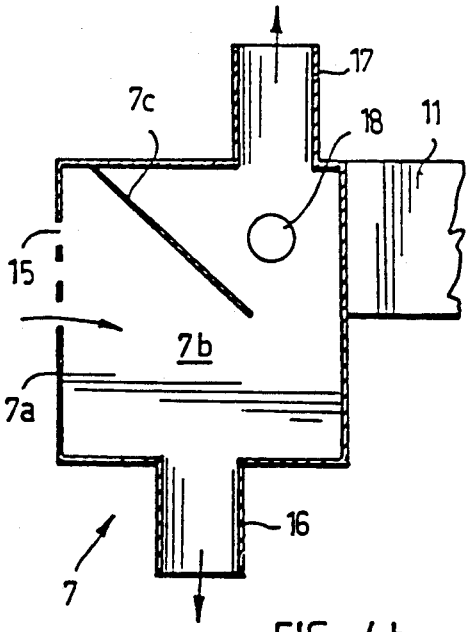
FIG. 4b
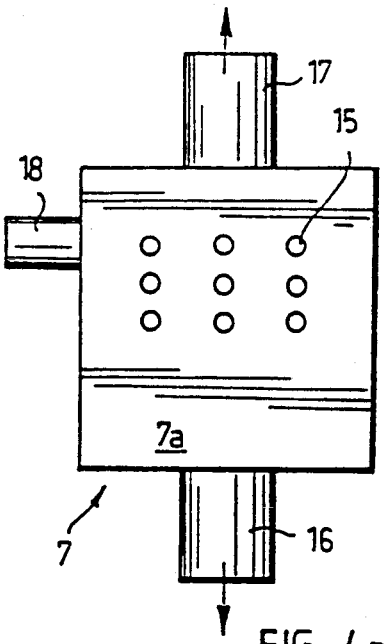
FIG. 4a

DEVICE FOR MEASURING THE CONDITION OF A FELT AND FOR RECONDITIONING IT

FIELD OF THE INVENTION

The invention relates to a reconditioning device for measuring the condition of a felt in a paper machine and for reconditioning it and, more particularly, a device, comprising a measuring head provided with a suction chamber and in the measuring head a measuring surface to be positioned against the surface of the felt and provided with suction holes leading into the suction chamber; a suction conduit leading out of the suction chamber and communicating with a vacuum source for sucking air and water through the suction holes from the felt into the suction chamber and for discharging water and air from the suction chamber; measuring means for measuring the vaccum pressure in the suction chamber; nozzles for spraying water into the felt for reconditioning it; and a displacing beam positioned in the transverse direction of the felt, the measuring head being mounted movably along the displacing beam.

BACKGROUND OF THE PRIOR ART

Paper machines or the like utilize press felts for absorbing water from a fiber web to increase its dry matter content. As used in this application and claims, the term paper machine refers to a paper machine, a board machine or other similar machine producing a web-like product from a fiber suspension. The absorbency of the press felt, typically described by its air permeability ($m^3/m^2$ min), decreases when the felt is compressed during operation in a nip formed by rolls. The air permeability of a new felt is typically about 15 $m^3/m^2$ min, and that of a felt which has totally lost its elasticity is about 2 to 1 $m^3/m^2$ min. Particles detached from the paper web also block the felt, but not to an equally high degree as the compression effect.

In principle, the compression takes place evenly when the press effect and structure of the rolls are perfectly even and symmetrical. If the press effect created by the rolls is asymmetric or the rotation of the felt is realized by so-called cambered rolls, the felt is compressed unevenly and asymmetrically. In the latter case, the central portion of the felt stretches more than the rest of it, so that its thickness and thus its water volume is smaller as compared with the edge portions. Paper machines also comprise so-called wet wires, the purpose of which is to transport away water removed from the fiber suspension and from the forming or formed fiber web. Such wet wires are also exposed to compression and they are blocked by loose material gathering in them similarly as other felt types.

A partly or totally blocked felt can be reconditioned by using high-pressure needle-like water jets, which are in general use today. Such needle jets increase the porosity of the felt and retard its ageing and blocking. In general, such water jets are effected by means of jet pipes provided in the apparatus so as to oscillate in the transverse direction of the felt. The pipes comprise needle nozzles at predetermined intervals, and the oscillating movement of the pipe is approximately equal to the distance between the needle jets. Particles gathered in the felt are removed by applying an ordinary detergent to the felt during a break in operation and allowing it to influence for some time, whereafter it is rinsed off. Wet wires are cleaned by means of needle jets similarly as felts, and their condition has to be monitored in a similar way. The term felt will be used below in this application and claims to refer to a felt, a wet wire and any other fabric used for similar purposes in a paper machine.

Various arrangements have been developed for reconditioning a felt and measuring its condition. GB Patent 1 458 294 discloses an arrangement utilizing a suction shoe provided with an elongated slit. A needle-like water jet is applied from one end of the slit to the felt, and the water sprayed into the felt is sucked through the slit into a vacuum chamber provided above the slit and removed through a suction conduit. The chamber is connected to a vacuum conduit and it communicates with the atmosphere only through the slit. The suction shoe is mounted in a beam extending in the transverse direction of the felt, and it is movable along the beam across the felt in its transverse direction, so that the needle-like water jet can be applied over the entire width of the felt. This arrangement is specifically intended for reconditioning although it is stated in the publication that the device can be used for analyzing the condition of the felt when the water jet is switched off. In practice, the air permeability of the felt cannot be reliably analyzed by means of this arrangement during normal operation because water from the wet felt blocks rapidly the discharge conduit or forms plugs distorting the measuring results so that the measured values are not logically proportional to the condition of the felt. Furthermore, the use of this arrangement for analyzing the condition of the felt is impossible in practice as the comparison should be made by reading a vacuum gauge connected to the vacuum conduit. In practice, it is not possible to observe sufficiently accurately the vacuum and determine manually the position of the measuring head with respect to the felt.

U.S. Pat. No. 3,056,281 discloses an arrangement for measuring the condition of a felt. It comprises sensors provided with a chamber, a suction conduit leading out of the chamber and a pressure gauge connected to measure the pressure of the chamber. The measuring surface of the sensor is provided with holes leading out of the chamber. The condition of the felt is measured by means of the device by positioning the surface with the holes against the felt while the operator observes the pressure values of the chamber from the pressure gauge. Although the arrangement can be used for measuring the condition of the felt, it is impossible in practice to mark the measured values accurately with respect to the surface of the felt so that it is impossible to monitor the condition of the felt as a whole. A problem with the arrangement of this publication, too, is that water from the wet felt easily blocks the suction conduit, causing abrupt illogical variation in the measured values so that the obtained information on the condition of the felt is not reliable.

CA Patent 1,143,982 discloses an arrangement in which the condition of the felt is monitored by measuring vaccum pressure in a conventional suction box and by switching on the cleaning jets over the entire width of the felt when the pressure drops below a predetermined limit and correspondingly switching off the jets when the pressure in the suction box rises, indicating improved air permeability of the felt. In this arrangement, it is not possible to locate the blockage in the felt, so that the reconditioning cannot be directed merely to the required area.

U.S. Pat. No. 3,762,211 discloses a solution in which the porosity of the felt is measured in its transverse direction by means of suction boxes mounted over the entire width of the felt. The suction boxes are divided in the transverse direction of the felt into several successive chambers and the boxes suck air and water through the felt, so that the flow rate of air removed at each compartment is measured by means of a separate measuring head. In this solution, water and air are passed apart from each other outside the primary suction chamber in order that the air flow could be measured. Water and air are, however, removed from the suction box along one and the same conduit, so that the air flow and water amount of all compartments are removed simultaneously. A drawback of this solution is that the measuring result of the air flow of each compartment is dependent on the air flow of the other compartments, and that the mixing of water and air in the common discharge conduit causes random variation in the measuring result, so that reliable information on the condition of the felt at its each particular point cannot be obtained.

SUMMARY OF THE DISCLOSURE

The object of the present invention is to provide a reconditioning and measuring device by means of which blockages in the felt can be measured either in the transverse direction of the felt or in the transverse and longitudinal direction so that only the area requiring cleaning and reconditioning can be subjected to the cleaning jets and other cleaning measures. A reconditioning device according to the invention is characterized in that the measuring head comprises at least two suction conduits for sucking water and air, the first suction conduit being positioned in the lower portion of the suction chamber for discharging mainly water from the suction chamber and the second suction conduit is positioned in the upper portion of the suction chamber for discharging mainly air from the suction chamber, whereby air and water are removed substantially apart from each other so that water does not form plugs affecting the measuring result in the air discharge conduit; the nozzles are mounted so as to move simultaneously with the measuring head along the displacing beam; and it comprises a control device for registering the vacuum pressure in the measuring head during measuring and for controlling the spraying of water for reconditioning the felt on the basis of the measured vacuum pressure.

The basic idea of the invention is that the measuring head comprises two conduits, one in its lower portion and the other in its upper portion so that the water removed from the felt by the vacuum effect is discharged through the lower conduit and air is discharged mainly through the upper conduit, and reconditioning nozzles connected to the measuring device. In this way the water is not mixed with the air to be discharged, thus avoiding the formation of plugs distorting the measuring result and the measured values will be directly proportional to the condition of the felt and deviations caused by water in the otherwise logical measuring result are avoided and reconditioning may be carried out directly according to the measured vacuum.

BRIEF DESCRIPTION OF THE DRAWINGS

The invention will be described in greater detail in the attached drawings, in which

FIGS. 3*a* and 3*b* illustrate schematically the device according to the invention in a measuring and reconditioning position and in a rest position, respectively, as seen in the transverse direction of the web;

FIGS. 4*a* and 4*b* illustrate schematically a measuring head used in the device according to the invention as seen in different directions.

DETAILED DESCRIPTION OF THE PREFERRED EMBODIMENTS

Figure 1:
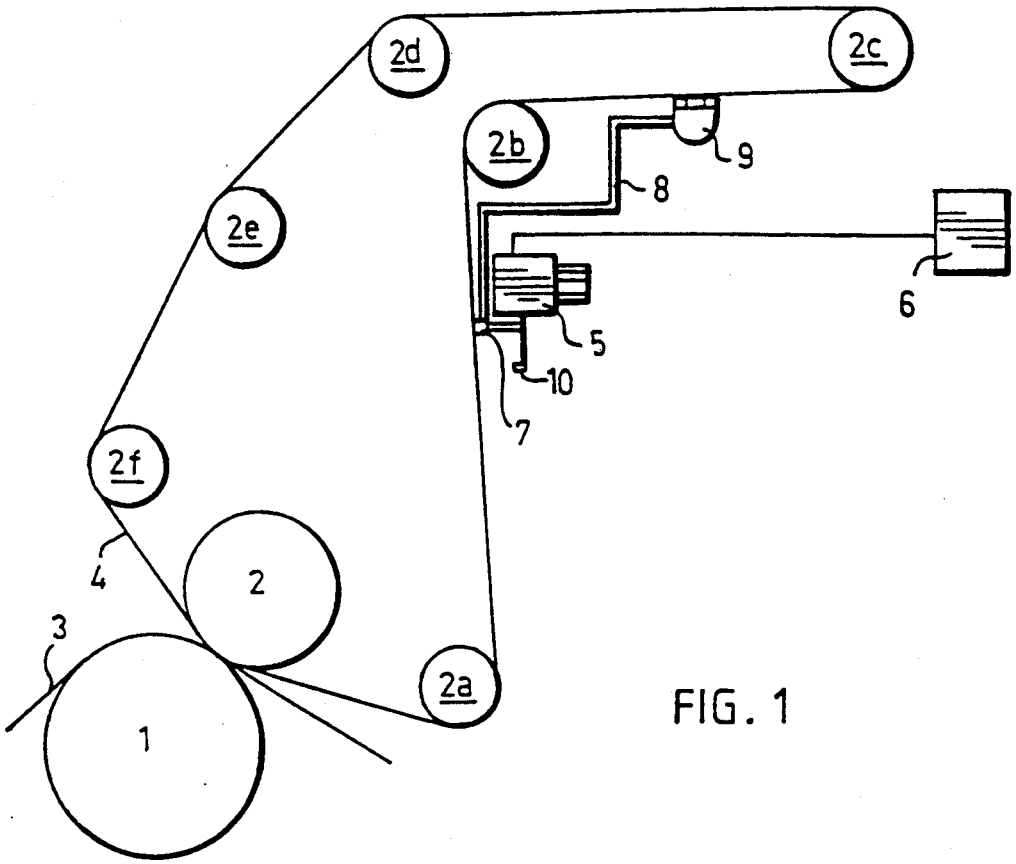
FIG. 1 illustrates schematically the mounting of a device according to the invention in the press section of a paper machine.

FIG. 1 illustrates schematically the mounting of the measuring device in the press section of a paper machine. The nip is formed by rolls 1 and 2 between which both a web 3 and a press felt or wire 4 pass. For the sake of clarity, only one felt or wire is shown in the figure, but the corresponding description applies to all wires or felts. In the following both the felt and the wire will be referred to as a felt for the sake of clarity. The felt moves around in a closed loop, guided by auxiliary rolls 2*a* to 2*f*, so that a predetermined point in the felt 4 passes through the nip again and again. A displacing beam 5 forming a track for the measuring device is mounted beside the path of the felt. Most of the measuring device is encased in the displacing beam, within which it moves. The measuring device comprises a control unit 6 which controls the operation of the device and its measuring head 7. In one embodiment of the invention, a vacuum conduit 8 leads from the measuring head 7 into a suction box 9 so as to create a vacuum in the measuring head. The device further comprises nozzles 10 through which needle jets are applied to the felt to recondition it.

Figure 2:
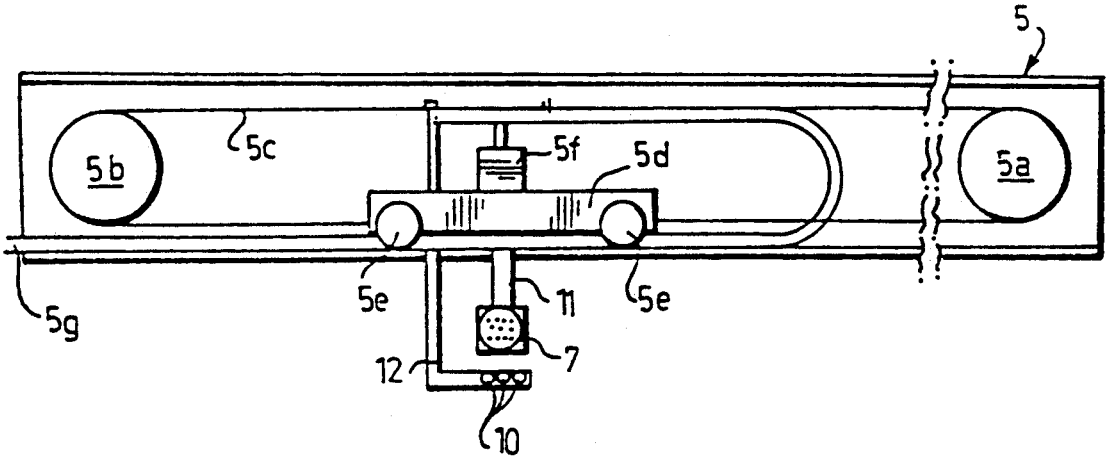
FIG. 2 illustrates schematically the device according to the invention as seen from the side of the web.

FIG. 2 is a more detailed, sectional view of the measuring device and the displacing beam 5 mounted in the press section of the paper machine in parallel with the surface of the felt in a direction transverse to the direction of travel of the felt. The measuring device is displaceable on the displacing beam 5. The displacing beam 5 comprises turning wheels 5*a* and 5*b* around which a chain or the like 5*c* extends so as to displace the measuring device in the transverse direction of the felt 4 during the measuring and reconditioning of the felt 4. A carriage 5*d* movable along the displacing beam 5 on wheels 5*e* is attached to the chain 5*c*. The measuring device further comprises a power device 5*f* by means of which the measuring head 7 is turned against the felt 4 into a measuring position and away from it. Reconditioning means comprise the measuring device with the measuring head 7 and the jet member with the needle nozzles 10 applying a water jet to the felt. Hoses and conduits 5*g* are connected to the reconditioning means for creating a vacuum and controlling the device. Measuring results obtained by the measuring device can be transferred to a control panel positioned outside it and to the registering device or control unit 6.

FIG. 3*a* shows schematically the reconditioning means as seen in the direction of the surface of the felt 4 which is movable within the preferably nearly closed displacing beam 5, being thus protected from splashing and excessive moisture and dirt. The reconditioning means comprise a turnable measuring arm 11 at the end of which the measuring head 7 is positioned. The needle nozzles 10 for use in the reconditioning are mounted in the measuring device by means of an arm 12 so as to turn together with the arm 11. In FIGS. 3*a* and 3*b*, the measuring device is mounted at the felt 4 moving in the vertical direction. In FIG. 3*a*, the measuring device is in the rest position, whereby the arm 11 and the measuring head 7 have been turned to the left in the figure, that is away from the felt 4, so that a clear gap remains therebetween. Correspondingly, the arm 12 has been turned to the left in the figure, so that the reconditioning jets 10 are away from the operating position and no measuring or reconditioning is performed. The arms 11 and 12 are interconnected and mounted turnably around a joint 13 with respect to the carriage 5*d*. Further, the power device 5*f* is connected to the arms by means of a joint 14 in such a manner that the arms can be turned by means of the power device 5*f* towards the felt 4 and correspondingly away from it.

FIG. 3*b* in turn shows the device in the measuring and reconditioning position. By turning the arm 11 to the right in the figure, the measuring head 7 can be positioned against the felt 4 so that it measures the condition of the felt moving in the direction shown by the arrow, that is, downwards in the figure. At the same time the jets 10 are turned by means of the arm 12 into the reconditioning position. The felt is reconditioned simultaneously as its condition is being measured or after the condition of the whole felt has been measured, by applying needle-like water jets through the nozzles 10 to the felt 4 at a point after the measuring head 7 in the direction of travel of the felt. In principle, the measuring head could be kept continuously against the felt 4. This, however, would wear out both the measuring head and the felt due to the rubbing occurring therebetween. On the other hand, the condition of the felt need not be measured continuously as the felt generally requires reconditioning at rather long intervals. So the wear can be avoided when the measuring head is kept against the felt 4 only during measuring and reconditioning.

FIGS. 4*a* and 4*b* are schematic views of a measuring head suitable for use in the device of the invention in different directions. As seen in the direction of the felt to be reconditioned, the measuring head 7 first comprises a sensor surface 7*a* with through-going holes 15. The holes 15 lead into a separation chamber 7*b* in which air and water removed from the felt through the holes 15 during the measuring step are separated from each other and are passed apart from each other. A first suction conduit 16 sucking mainly water which has entered the separation chamber 7*b* extends from the lower portion or lower surface of the separation chamber 7*b*. Correspondingly, a second suction conduit 17 sucking mainly air from the separation chamber extends from the upper portion or upper surface of the separation chamber 7*b*. A baffle plate 7*c* is provided in the separation chamber 7*b* for facilitating the separation of water and air. The baffle plate 7*c* extends downwards from the measuring surface 7*a* towards the back portion of the separation chamber 7*b* but it does not divide the separation chamber 7*b*. The measuring head 7 further comprises a connection 18 for a vacuum measuring sensor for measuring the condition of the felt and its air permeability. The suction conduits 16 and 17 may be equal or unequal in cross-section. They may communicate through a vacuum conduit with one and the same vacuum source, such as a suction box or other similar device, or with different vacuum sources. In a preferred embodiment, the vacuum source is a suction box and the cross-section of the water discharge conduit 16 extending from the lower portion of the measuring head 7 is slightly smaller than that of the air discharge conduit 17, so that the discharge operation of the conduits will be kept at a suitable ratio.

The device operates in the following way. On measuring the condition of the felt, the measuring head 7 is turned against the surface of the felt so that it is positioned at the edge of the felt 4. At the same time the suction devices, that is the vacuum devices are started so as to suck air from the measuring head 7 and also to suck water which has entered the measuring head, thus creating vacuum. When the air and water are discharged through the conduits 16 and 17, a vacuum proportional to the air permeability of the felt, and thus to the condition of the felt, is created in the separation chamber. The condition of the felt can be measured by the measuring device either over a single stripe-like surface portion having a predetermined width in the direction of width of the felt or over the entire width of the felt at predetermined intervals so that the condition of the entire felt can be measured. Correspondingly, the measuring can be performed by dividing the felt into portions of predetermined length in the direction of travel of the felt, whereby the entire surface area of the felt can be divided into portions of predetermined width and predetermined dimensions and the air permeability of each portion can be registered separately in the control device and the registering device. One way of reconditioning the felt by means of water jets applied through the nozzles is to first register the condition of the entire felt and then separately recondition the required portions while monitoring their condition by means of the measuring device. When the measuring head 7 reaches a felt portion in bad condition, the measuring device switches on the water jets to recondition this felt portion until the vacuum pressure in the measuring head 7 rises sufficiently, indicating a felt portion of better condition, so that the supply of water through the nozzles is stopped. This can be repeated within one felt surface area in the direction of width of the felt until all felt portions in bad condition within this area have been reconditioned to a predetermined level, whereafter the measuring head is displaced onwards in the direction of width of the felt and the simultaneous measuring and reconditioning are continued over the entire width of the felt. Correspondingly, the felt can be reconditioned by first measuring the condition of the entire felt either as stripes extending over the felt in the direction of its width or as surface area portions of predetermined dimensions in the direction of length and width of the felt, and the felt portions in bad condition are reconditioned separately one at a time after the measuring has been completed. Of course, the entire felt can be washed and reconditioned by means of the device in such a way that the device is displaced at constant speed over the entire width of the felt or over a predetermined distance in the direction of width at a time while continuously feeding water through the nozzles and registering the condition of the felt by monitoring the vacuum pressure of the measuring head 7.

Figure 5:
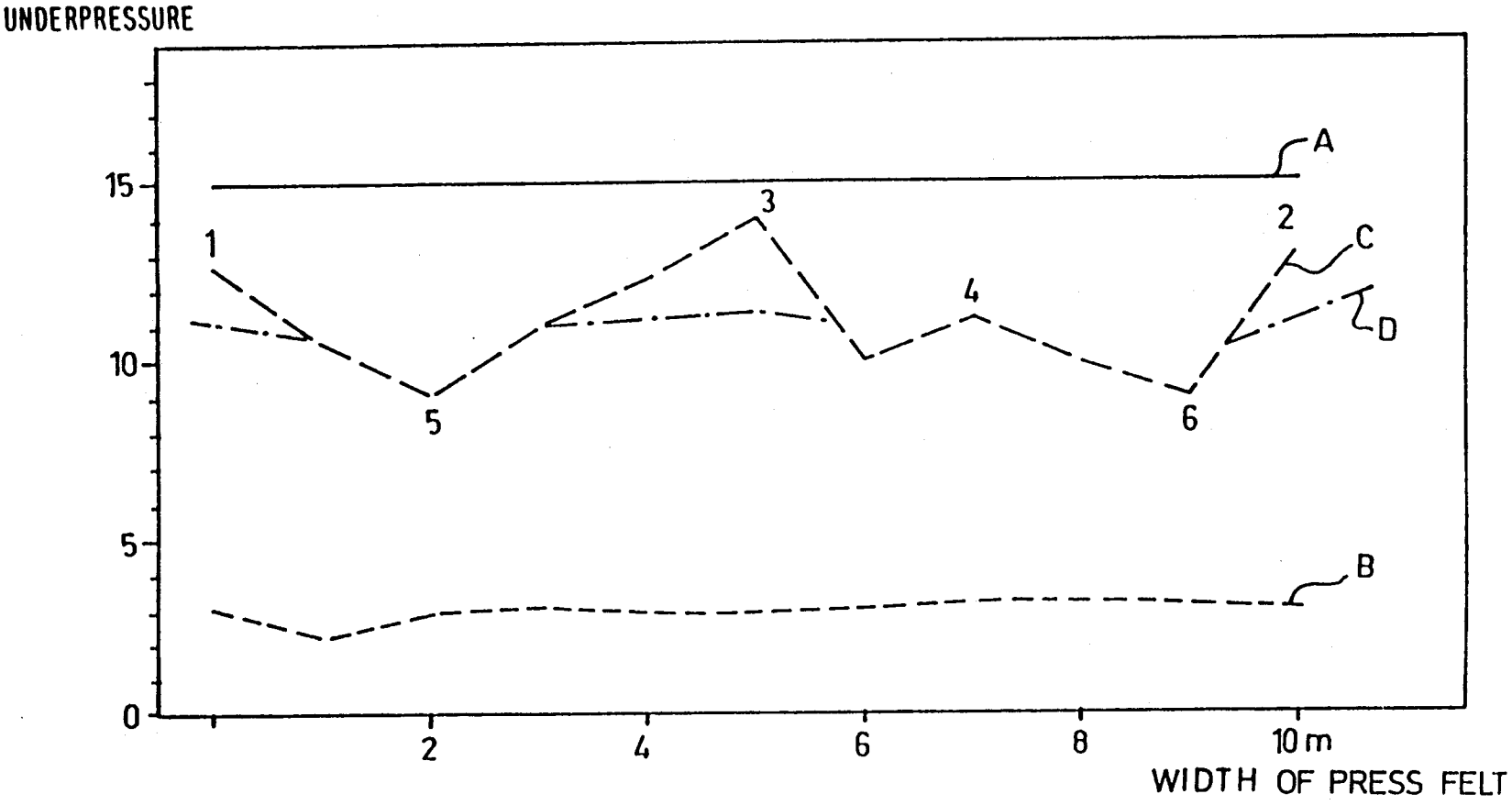
FIG. 5 illustrates schematically measuring curves obtrained by means of the device according to the invention and permeability curves obtained after reconditioning carried out on the basis of the measuring.

FIG. 5 shows schematically curves representing the condition of one specific felt when measured and reconditioned by means of the reconditioning device of the invention. To obtain a basic level for reference curves, the absolute vacuum pressure created at the measuring head during the operation of the vacuum device is always measured first on initiating the measuring. This line across the felt is indicated with A and it shows that the vacuum pressure of the measuring head 7 is constant in the direction of width, which indicates that the hoses and connections of the device are in working condition. The value of the line A may vary as the vacuum devices operate in different ways due to variations in the operating power or some other parameters. At the measuring moment, however, this value is usually sufficiently constant, so that a so-called relative coefficient is obtained for curves to be measured later on from the felt. In FIG. 5, the letter B indicates a broken line obtained from the felt immediately when this felt was taken into use, at which stage its properties were still unaffected and its quality and the evenness of its quality such as provided by the manufacturer. On measuring the felt to be reconditioned, a curve typically similar to the curve indicated with the letter C is obtained, which in this case is measured in the direction of width of the felt at uniform intervals without dividing the felt in the longitudinal direction into different lengths. It is to be seen that the felt is blocked at the edges and in the middle at points indicated with the numerals 1 to 4 whereas the condition of the felt is at best at points indicated with the numerals 5 and 6. In practice, the basic principle in the reconditioning of the felt is that the condition of the felt in the direction of its width and to such an extent as possible also in the direction of its length should be made as even as possible. After the felt has been reconditioned e.g. by applying the water jets through the nozzles 10 to the most severely blocked points, the end result could be such as represented by the broken line D, for instance. In this situation the condition of the points 1 to 3 has improved, that is, the portions in bad condition have been partly reconditioned whereas the point 4, which has not yet been subjected to reconditioning, is still in better condition than the reconditioned points 1 to 3. The ideal would be, of course, to obtain a line as straight as possible in the direction of width of the felt; in practice, however, this is not possible. Therefore, the reconditioning is first subjected to felt portions in worst condition and then increased and expanded as the values obtained from these portions approach those obtained from the other felt portions.

The invention has been described by way of example above and in the drawings, and it is in no way restricted to them. The structure of the measuring device may be realized in various way and its connection both electrically and in other ways can also be realized in various ways. Various devices for creating vacuum and realizing the measuring of the condition of the felt, that is, its air permeability can be used within the scope defined by the claims. Various ways of measurement and measuring and reconditioning combinations can be used according to the invention, and the device according to the invention can, of course, be used merely for measuring the condition of the felt and registering the original air permeability of the felt and merely for reconditioning the felt over its entire width without any measuring step.

I claim:

1. A reconditioning device for measuring the condition of a felt in a paper machine and for reconditioning it, comprising:

a measuring head provided with a suction chamber, having a measuring surface to be positioned against a surface of the felt and provided with suction holes leading into the suction chamber;

a first conduit leading out of the suction chamber and communicating with a vacuum source to provide a vacuum in the suction chamber for sucking both air and water through the suction holes from the felt into the suction chamber and for discharging air from the suction chamber;

measuring means for measuring a vacuum pressure in the suction chamber;

nozzles for spraying water into the felt for reconditioning it;

a displacing beam positioned in a transverse direction of the felt, the measuring head being mounted movably along the displacing beam; and a control device for registering the vacuum pressure in the measuring head during operation for measuring and for controlling the spraying of water for reconditioning the felt on the basis of the measured vacuum pressure, wherein the measuring head also comprises a second conduit positioned in a lower portion of the suction chamber for discharging mainly water from the suction chamber the first conduit being positioned in an upper portion of the suction chamber for discharging mainly air from the suction chamber, whereby air and water are removed substantially apart from each other so that water does not form plugs affecting the measuring result in the air discharge conduit, the nozzles are mounted so as to move simultaneously with the measuring head along the displacing beam, the measuring head being mounted on a first arm means, and the nozzles being mounted on a second arm means interconnected with the first arm means, said first and second arm means being structured such that the nozzles and the measuring head are mounted separately from one another.

2. Reconditioning device according to claim 1, wherein:

the suction chamber comprises a baffle plate extending from the measuring surface between the suction conduits for guiding water downwards into the lower portion of the suction chamber and for separating water and air from each other.

3. Reconditioning device according to claim 1, wherein:

the cross-sectional area of the water discharge conduit of the measuring head is smaller than that of the air discharge conduit.

4. Reconditioning device according to claim 1, wherein:

the said first and second conduits of the measuring head communicate with a common vacuum source.

5. Reconditioning device according to claim 1, further comprising:

a power device for selectively moving the measuring head and the nozzles into a measuring-and-reconditioning position and away from it.

* * * * *